US005311415A

United States Patent [19]

Hyland

[11] Patent Number: 5,311,415

[45] Date of Patent: May 10, 1994

[54] UNIVERSAL FOLDABLE LAMP SHADE COVER

[76] Inventor: Barbara B. Hyland, 1391 Siesta Bayside Dr., Sarasota, Fla. 34242

[21] Appl. No.: 118,454

[22] Filed: Sep. 8, 1993

[51] Int. Cl.[5] ..... F21V 1/06

[52] U.S. Cl. ..... 362/352; 362/457; 362/806; 362/450

[58] Field of Search ..... 362/352, 457, 806, 357, 362/351, 360, 450, 433, 451, 452

[56] References Cited

U.S. PATENT DOCUMENTS

| | | | |
|---|---|---|---|
| 3,161,358 | 12/1964 | Gottlieb | 362/357 |
| 3,385,963 | 5/1968 | Washick | 362/357 |
| 4,055,760 | 10/1977 | Weisbrod | 362/352 |
| 4,354,222 | 10/1982 | Gall | 362/352 |
| 4,605,996 | 8/1986 | Payne | 362/352 |
| 4,625,268 | 11/1986 | Payne | 362/352 |
| 4,646,216 | 2/1987 | Ghong et al. | 362/352 |
| 4,727,461 | 2/1988 | Naumoff et al. | 362/352 |
| 4,731,715 | 3/1988 | Anderson | 362/806 |
| 5,121,312 | 6/1992 | Hyland et al. | 362/352 |
| 5,193,902 | 3/1993 | Hyland et al. | 362/352 |

FOREIGN PATENT DOCUMENTS

| | | | |
|---|---|---|---|
| 0325878 | 8/1989 | European Pat. Off. | 362/352 |

*Primary Examiner*—Ira S. Lazarus
*Assistant Examiner*—Sara Sachie Raab
*Attorney, Agent, or Firm*—Charles J. Prescott

[57] ABSTRACT

A universal foldable lamp shade cover which includes a uniformly pleated rectangular sheet of thin, somewhat rigid yet bendable material having a plurality of side-by-side slender elongated panels integrally connected one to another in accordion fashion along a fold line between each panel. The side margins of the pleated sheet are connected to form a somewhat tubular member which is sized, when reduced in circumference at its upper end, to be held in place primarily by a locking tie or clip arrangement which is interengageable between an aperture formed through a few evenly spaced selected panels adjacent their upper margins and an upper rigid margin of the lamp shade.

9 Claims, 2 Drawing Sheets

UNIVERSAL FOLDABLE LAMP SHADE COVER

BACKGROUND OF THE INVENTION

This invention is generally related to lamp shades, and more particularly to a removable, universal, foldable lamp shade cover.

The construction of conventional lamp shades is well known and typically require replacement long before the lamp itself is either worn or desired to be replaced for decorative considerations. However, in replacing a conventional lamp shade, both size and decorative considerations become somewhat restrictive in selecting a replacement. Additionally, seasonal or festive considerations may make it desirable to temporarily alter the appearance of one or more lamp shades in a room or home setting.

One such device for accomplishing this is disclosed in U.S. Pat. No. 4,731,715 to Anderson which is directed to a conformable covering fabricated from a rectangular swath of cloth which may be fitted over a conventional lamp shade.

Other uniquely constructed lamp shades and lamp shade covers are as follows:

| | |
|---|---|
| Gottlieb | 3,161,358 |
| Washick | 3,385,963 |
| Weisbrod | 4,055,760 |
| Gall | 4,354,222 |
| Payne | 4,625,268 |
| Naumoff, et al. | 4,727,461 |
| Payne | 4,605,996 |
| Chong, et al. | 4,646,216 |

However, none of these references is of a nature similar to that of the present invention.

I have also been granted two prior U.S. Pat. Nos. 5,121,312 and 5,193,902 which are directed to a cover structure similar to that of the present invention, but being less than ideally suited for motel and hotel environments which experience aggressive occupants who may tend to remove and leave with these prior art devices.

The present invention provides a universal, foldable lamp shade cover which may be manufactured from any convenient semi-rigid decorative material which is formed into a uniformly pleated rectangular sheet bendable primarily about the fold lines between each slender panel in accordion fashion. This structure has sufficient pliability about the fold lines so as to conform to a broad range of lamp shade sizes of perimeters and lengths and shapes. Moreover, the device is structured to rest atop and be easily and quickly secured to a tapered lamp shade. This invention will also function and be retained atop a cylindrical or straight-sided lamp shade as well. Compact storage is also provided.

BRIEF SUMMARY OF THE INVENTION

This invention is directed to a universal foldable lamp shade cover which includes a uniformly pleated rectangular sheet of thin, somewhat rigid yet bendable material having a plurality of side-by-side slender elongated panels integrally connected one to another in accordion fashion along a fold line between each panel. The side margins of the pleated sheet are connected to form a somewhat tubular member which is sized, when reduced in circumference at its upper end, to be held in place primarily by a locking tie or clip arrangement which is interengageable between an aperture formed through a few evenly spaced selected panels adjacent their upper margins and an upper rigid margin of the lamp shade.

It is therefore an object of this invention to provide a universal, foldable lamp shade cover which may be fabricated from a virtually limitless selection of semi-rigid, bendable decorative materials.

It is another object of this invention to provide a universal lamp shade cover which will decoratively cover a conventional lamp shade, thus providing a completely different decorative lamp shade appearance without the need for lamp shade replacement.

It is yet another object of this invention to provide a universal lamp shade cover which is expandable to fit over and cover a very broad range of lamp shade sizes of perimeters and lengths and shapes.

It is yet another object of this invention to provide a universal lamp shade cover which may substantially alter the decorative length configuration of a conventional lamp shade.

It is yet another object of this invention to be compactly storable.

In accordance with these and other objects which will become apparent hereinafter, the instant invention will now be described with reference to the accompanying drawings.

DETAILED DESCRIPTION OF THE INVENTION

Figure 1:
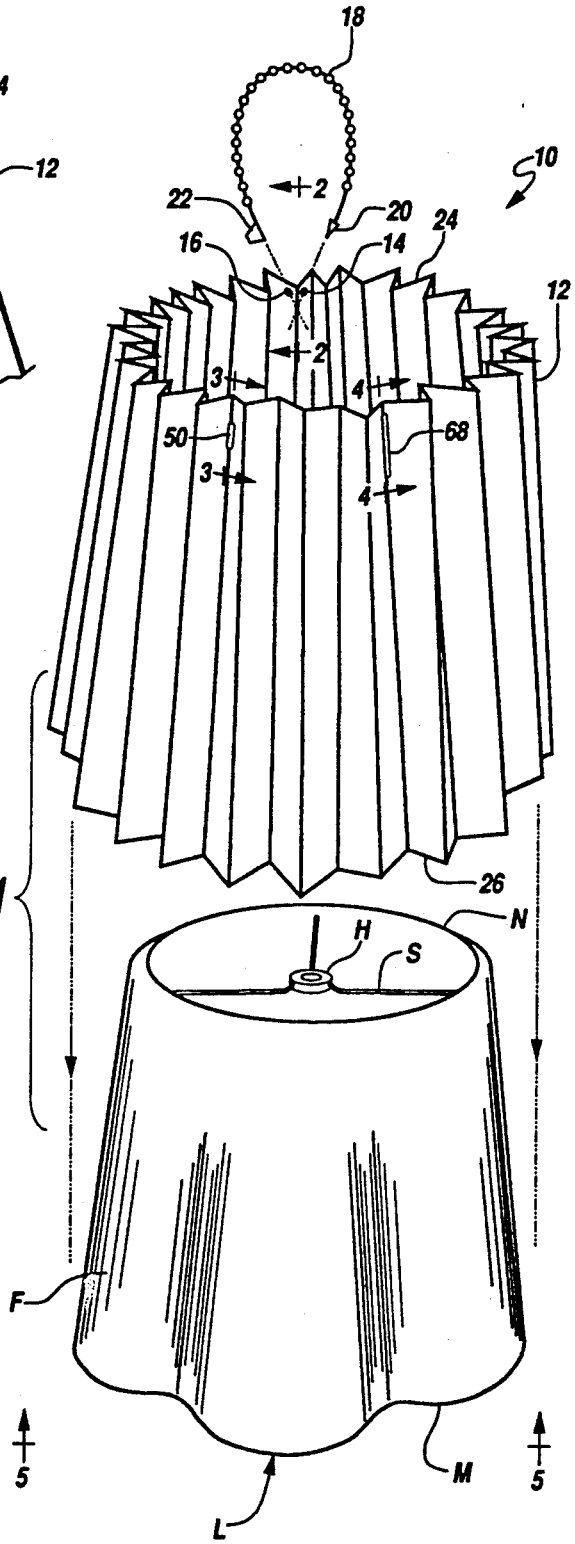
FIG. 1 is an exploded perspective view of the invention fitted over a conventional lamp shade and showing all embodiments of the attaching means.

Referring now to the drawings, and particularly to FIG. 1, the preferred embodiment of the invention is shown generally at numeral 10. This lamp shade cover 10 is fabricated of a pleated sheet 12 formed of relatively stiff, yet foldable decorative material sufficiently rigid so as to maintain a free-standing shape as shown in FIG. 1, yet sufficiently pliable so as to be expandable in accordion fashion.

Figure 5:
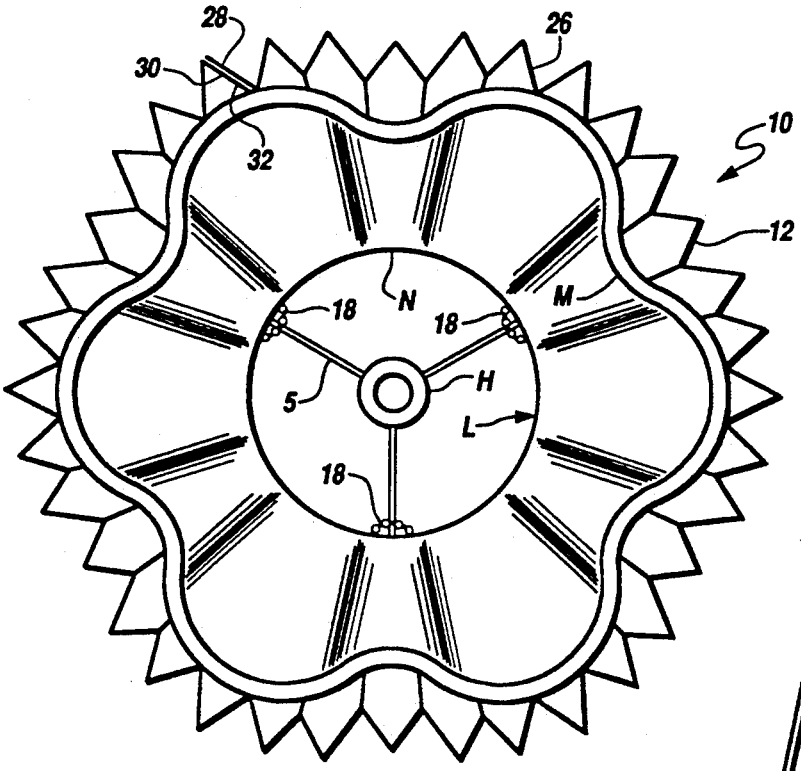
FIG. 5 is a view in the direction of arrows 5—5 in FIG. 1.
Figure 7:
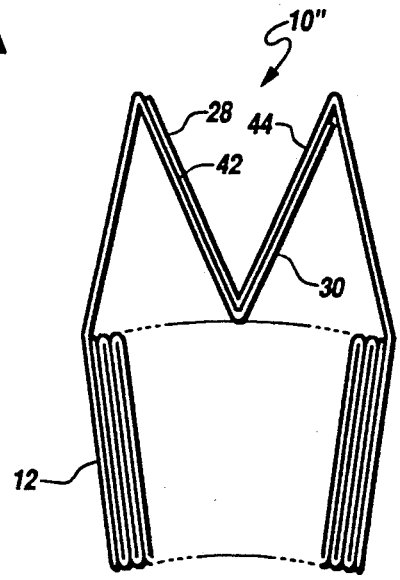
FIG. 7 is an end view of the invention in its stored configuration and showing yet another configuration for connecting the side margins of the pleated sheet.
Figure 6:
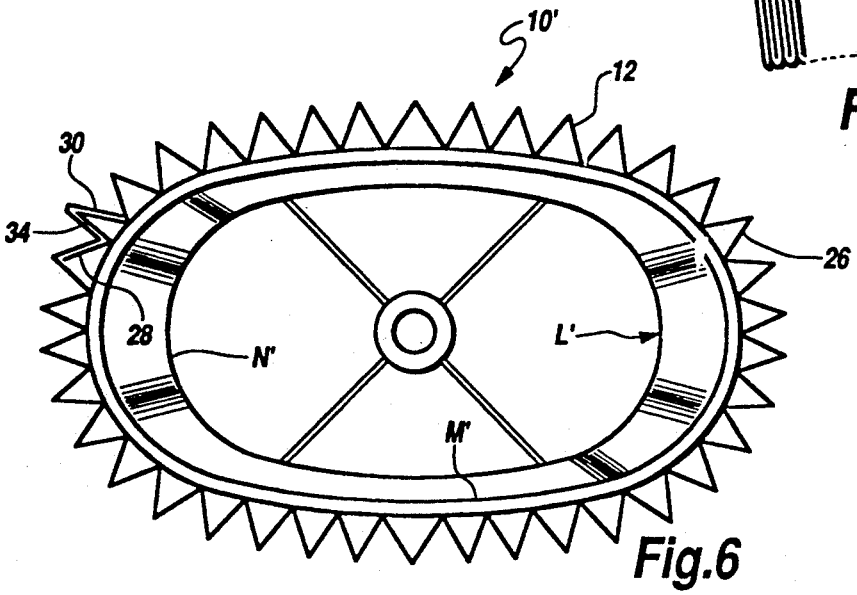
FIG. 6 is a view similar to FIG. 5 in conjunction with an irregularly shaped lamp shade.

Referring additionally to FIGS. 5 to 7, edge panels 28 and 30 of pleated sheet 12 are overlapped and adhered together along surface 32 by conventional adhesive, double-sided adhesive tape, sewn seam, or the like so as to form the generally tubular-shaped member depicted in FIG. 1.

The cover 10 is shown in FIG. 1 reduced in circumference at an upper margin 24 ready for slidable fitting downwardly over a conventional lamp shade L. No further preparation is required to fit the cover 10 in snug position over and substantially or fully covering the lamp shade L. Because most lamp shades are tapered upwardly, the cover 10 will remain in position decoratively covering the lamp shade L, aided by one of the embodiments of cover 10 to lamp shade L interconnecting means best seen in FIGS. 2 to 4 a described below and will thus also function adequately when fitted over a cylindrical lamp shade.

Figure 2:
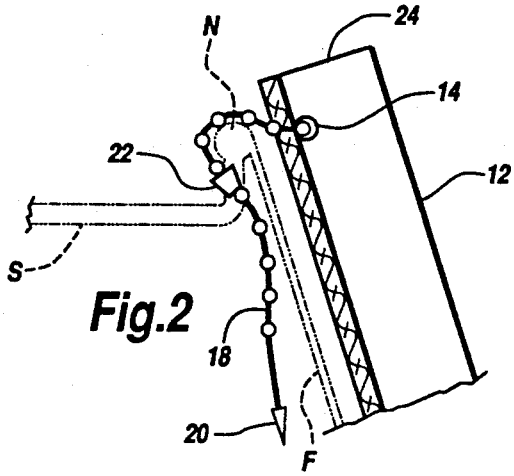
FIG. 2 is a section view in the direction of arrows 2—2 in FIG. 1.

Still referring to FIGS. 1 and 2, in situations such as hotels and motels, it is desirable to render the invention 10 somewhat immobile once installed. To accomplish this, a locking tie 18, formed of integrally molded flexible plastic and having a plurality of beads extending along the main body thereof, is preferred. This locking tie 18 includes an apertured locking boss 22 at one end thereof and a pointed tip 20 at the other end thereof. The pointed end 20 is first passed through each of a pair of apertures 14 and 16 formed through two adjacent panels of the pleated sheet 12 just below the upper margin 24 thereof. Thereafter, the pointed ends 20 and the locking boss 22 are passed inter-engageably around a spoke S of the lamp shade L and then lockably inter-engaged in a well-known manner.

The preferred embodiment of the locking tie 18 is supplied by Dennison Manufacturing Company of Framingham, Mass. under its trademark SECUR-A-TIE. Although other such locking ties are available, the SECUR-A-TIE is not only lockably engageable in this manner, but may also be reversibly disengaged without damaging the locking tie 18.

The pairs of apertures 14 and 16 are periodically evenly spaced around the upper margin 24 so as to coincide with the number and spacing of each of the spokes S of the lamp shade L for even support of the cover 10 over the lamp shade L.

Figure 3:
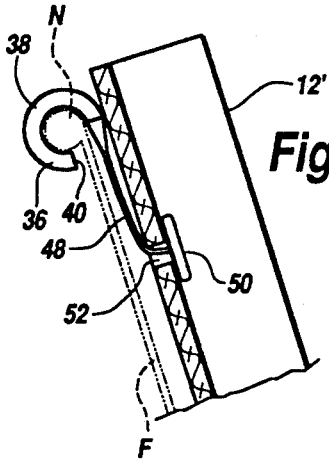
FIG. 3 is a section view in the direction of arrows 3—3 in FIG. 1.

Referring now to FIGS. 1 and 3, an alternate embodiment of the interconnecting means is there shown in the form of a flexible molded plastic hanger 36 having a generally C-shaped head 38 sized for lockable supportive engagement over the upper margin end of the lamp shade L. The hanger 36 also includes a slender flexible stem 48 which extends from one end of the C-shaped head 38 to terminate in an enlarged locking tab 50. The locking tab 50 is biasably deformable from an orthogonal orientation with respect to stem 48 so as to be shoved through aperture 52 formed through the pleated sheet 12 and thereafter to return to its at-rest position shown in FIG. 3. By this arrangement, then, the hanger 36 may not be withdrawn from interengagement with aperture 52. By spacing a plurality of these hangers 36 evenly around the upper margin N, the pleated sheet 12' is uniformly supported as shown.

Figure 4:
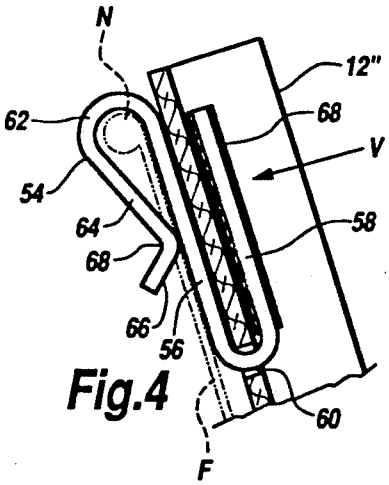
FIG. 4 is a section view in the direction of arrows 4—4 in FIG. 1.

Referring now to FIGS. 1 and 4, another embodiment of the interconnecting means is there shown in the form of a wire clip 54 having a generally S-shaped configuration. One leg 58 of clip 54 is insertable through an aperture 60 formed through the pleated sheet 12'', a middle portion of the clip 54 upwardly extending at 56 so as to act with leg 58 to squeezably engage the pleated sheet 12'' therebetween.

The clip 54 also includes an upper intermediate reverse bend 62 which, in combination with downwardly extending leg 64, provides a biased engagement over the upper margin N. Reverse bend 68 provides a biased engagement against the fabric F of the lamp shade L, with tang 66 facilitating the engagement over the enlarged upper margin N.

Because the clip 54 is most economically and preferably made of formed spring wire material, leg 58 is thus exposed having an unattractive color with respect to the typical color choices for the pleated sheet 12''. To conceal this rather unattractive leg 58, a decoratively colored plastic tube 68 is also provided which will slidable engage over the entire exposed length of leg 58. Obviously, the color of the plastic sleeve 68 is chosen so as to blend with that of the pleated sheet 12''.

Referring now to FIGS. 5 and 6, the compliability of the embodiments 10 and 10' of the invention around irregular shaped lamp shades L and L' each having its own distinctively shaped upper and lower margins N and M or N' and M' is there shown. Thus, from the standpoint of both size and shape accommodation, either embodiment of the invention 10 or 10' is fully capable of expanding as required and exhibiting sufficient pliability so as to generally maintain the overall shape of the lamp shade L or L'.

Moreover, the length of the tubular member 12 may be selected so as to be substantially longer than the height of the lamp shade such that either the upper margin 24 or the lower margin 26 may extend either above, or below, the upper or lower margins, respectively of a lamp shade. Because of the relatively stiff nature of the pleated sheet, the overall tubular shape, in the form of a truncated cone as in FIG. 2, will uniformly extend the existing shape of the lamp shade itself so as to alter the decorative impact thereof.

Referring lastly to FIG. 7, the invention is shown in another alternate form at 10'' in its fully folded or stored configuration. In this embodiment 10'', the same pleated sheet 12 is adhered along overlapping edge panels 28 and 30 and the panels 42 and 44 adjacent to each so as to increase the overall strength of the tubular shape.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A universal foldable lamp shade cover comprising:

a uniformly pleated rectangular sheet of thin, bendable material;

said pleated sheet defined by a plurality of side-by-side slender elongated rectangular panels integrally connected one to another in accordion fashion along a fold line between each said pleated panel ending in an end panel at each end of said pleated sheet;

means for connecting said end panels together to form a generally tubular member;

said tubular member having a relaxed circumference sized to fit around a lamp shade;

an aperture formed through each of a sele· ted number of said panels evenly spaced around and positioned immediately adjacent an upper margin of said pleated sheet;

means engageable through each said aperture for releasibly interconnecting said tubular member to the lamp shade to provide an only means for hanging support of said tubular member in position over the lamp shade whereby said tubular member will rest over and substantially cover the lamp shade.

2. A universal foldable lamp shade cover as set forth in claim 1, wherein: said tubular member is sized to expand and fit over a wide range of circumferences of lamp shades.

3. A universal foldable lamp shade cover as set forth in claim 1, wherein: said tubular member has a length substantially longer than the height of the lamp shade.

4. A universal foldable lamp shade cover as set forth in claim 1, wherein:

said tubular member is sufficiently compliant along said fold lines to conform around non-circular lamp shades.

5. A universal foldable lamp shade cover as set forth in claim 1, wherein:

said tubular member is collapsible along said fold lines into a compressed configuration for storage.

6. A universal foldable lamp shade cover as set forth in claim 1, wherein said interconnecting means includes:

a flexible locking tie engageable through two opposing said apertures formed through two adjacent said panels and extending around a spoke of the lamp shade.

7. A universal foldable lamp shade cover as set forth in claim 1, wherein said interconnecting means includes:

a generally s-shaped wire clip having a first leg thereof insertable through said aperture and a second leg thereof sized for tight supportive engagement over the upper margin of the lamp shade.

8. A universal foldable lamp shade cover as set forth in claim 7, further comprising:

a decorative tube slidable engageable over said first leg;

said decorative tube being selectively colored with respect to a color of the lamp shade whereby said first leg is visually unobtrusive.

9. A universal foldable lamp shade cover as set forth in claim 1, wherein said interconnecting means includes:

a molded plastic hanger having a generally c-shaped head sized for lockable engagement over the upper margin of the lamp shade;

said hanger also having a flexible slender stem extending from one end of said c-shaped head and terminating at an enlarged tab;

said tab sufficiently flexibly connected to said stem for insertion through said aperture, after which said tab biasingly returns to an at-rest position wherein said tab may not be manually pulled back through said aperture.

* * * * *